US005256129A

United States Patent [19]

Boix Jaen

[11] Patent Number: 5,256,129

[45] Date of Patent: Oct. 26, 1993

[54] BOX FORMING APPARATUS WITH EXTENSIBLE WING ELEMENTS

[75] Inventor: Jose Boix Jaen, Elche, Spain

[73] Assignee: Boix Maquinaria, S.A., Leche, Spain

[21] Appl. No.: 906,862

[22] Filed: Jul. 1, 1992

[30] Foreign Application Priority Data

Jan. 24, 1992 [ES] Spain ..... 9200153

[51] Int. Cl.[5] ..... B31B 3/44

[52] U.S. Cl. ..... 493/171; 493/167; 493/474

[58] Field of Search ..... 493/167, 168, 171, 472, 493/474, 476

[56] References Cited

U.S. PATENT DOCUMENTS

| | | | |
|---|---|---|---|
| 1,365,920 | 1/1921 | Joslin | 493/167 |
| 1,400,292 | 12/1921 | Joslin | 493/167 |
| 1,582,205 | 4/1926 | Wrigley | 493/476 |
| 1,657,642 | 1/1928 | Pouzar | 493/472 |
| 1,826,260 | 10/1931 | Schwarz et al. | 493/476 |
| 1,835,401 | 12/1931 | Joslin | 493/167 |
| 4,493,682 | 1/1985 | Bryson et al. | 493/472 |
| 4,562,686 | 1/1986 | Focke | 493/183 |
| 4,674,998 | 6/1987 | Benedicenti | 493/476 |

*Primary Examiner*—William E. Terrell
*Attorney, Agent, or Firm*—Darby & Darby

[57] ABSTRACT

A box forming apparatus for forming a box from a pressed cardboard blank which has been introduced on a forming matrix. The apparatus has two rectangular end plates joined together by a bridge by means of a guide and bolt system in each plate. The guide and bolt system permits variation and adjustment of the height of the apparatus with regard to the machine support. Two winged plates are pivotally attached between the end plates, the winged plates pivoting freely without the aid of pistons or springs. The respective axes of rotation of each of the wings is located at their respective top edges. The pivoting of the wings is delimited by round profiles, or stops, located on the end plates at two separate locations. One set of the stops prevent motion inward towards the center of the end plates, while a second set of stops prevent motion outward away from the center of the end plates. The wings have a bevelled bottom edge for relatively free sliding motion as the wings contact the cardboard blank.

5 Claims, 6 Drawing Sheets

BOX FORMING APPARATUS WITH EXTENSIBLE WING ELEMENTS

OBJECT OF THE INVENTION

As is expressed in the title of this specification, the present invention refers to some improvements introduced in cardboard box forming machines, and as such, they provide a series of relevant features regarding present conventional machines used for the same purpose.

The object of the present invention consists of designing a new extensible forming element used in this type of machine, that is introduced in a matrix upon which the cardboard box is formed, with the particularity of being simple, extensible and interchangeable for different sizes of boxes.

BACKGROUND OF THE INVENTION

Presently a multitude of machines designed to form cardboard boxes from previously pressed flat sheets are known. These machines all coincide in the way of forming the box. The former is introduced in a matrix upon which the box is formed and the box is subsequently ejected.

The circumstance that the former is extensible is due to the need to reduce its size in order to come out of the matriz once the box has been formed when the box has horizontal bridges. If the box does not have horizontal bridges, the former could be stationary, in other words, not extensible.

Presently, extensible formers have complicated pneumatic expansion devices that have bearings, pneumatic cylinders, etc. and besides they are not interchangeable; in other words, as there is a large number of measurements of boxes it is necessary to have the corresponding formers.

If we take into account the number of sizes of boxes that exist, we are talking about having an infrastructure of spares which is enormous with all the inconveniences that this involves.

DESCRIPTION OF THE INVENTION

In order to avoid the above cited problems, the new analysis shatters the present concept of extensible core.

This is structurally studied to endure the pressures of the different box forming devices and at the same time it has an extensible device without pneumatic or similar elements.

This extensible former is formed by two rectangular wings that pivot regarding the top edge thereof, these being articulated by both top ends with some opposite vertical plates, joined together by a bridge, by means of a guides system located in the inside wall of each plate that permits variation of the height regarding the machine support.

The bottom ends of these wings are prepared so that upon descending and coming in contact with the bottom of the box to be folded, they open and pivot up to a stop formed by a bar situated at a certain height, between the vertical plates.

Once the box has been formed, the former rises, closing the wings by gravity until another established stop, without ever troubling the horizontal bridges of the formed box.

This extensible former is capable of covering all extensible measurements of boxes with only for or five spares, it even being able to be fixed upon the side plates being joined by means of a top sheet, as an interior top surface.

In order to provide a better understanding of the features of the invention and forming an integral part of this specification, some sheets of drawings in whose figures, the extensible former object of the invention has been represented in an illustrative and non-restrictive, have been attached hereto.

DESCRIPTION OF THE PREFERRED EMBODIMENT

Figure 1:
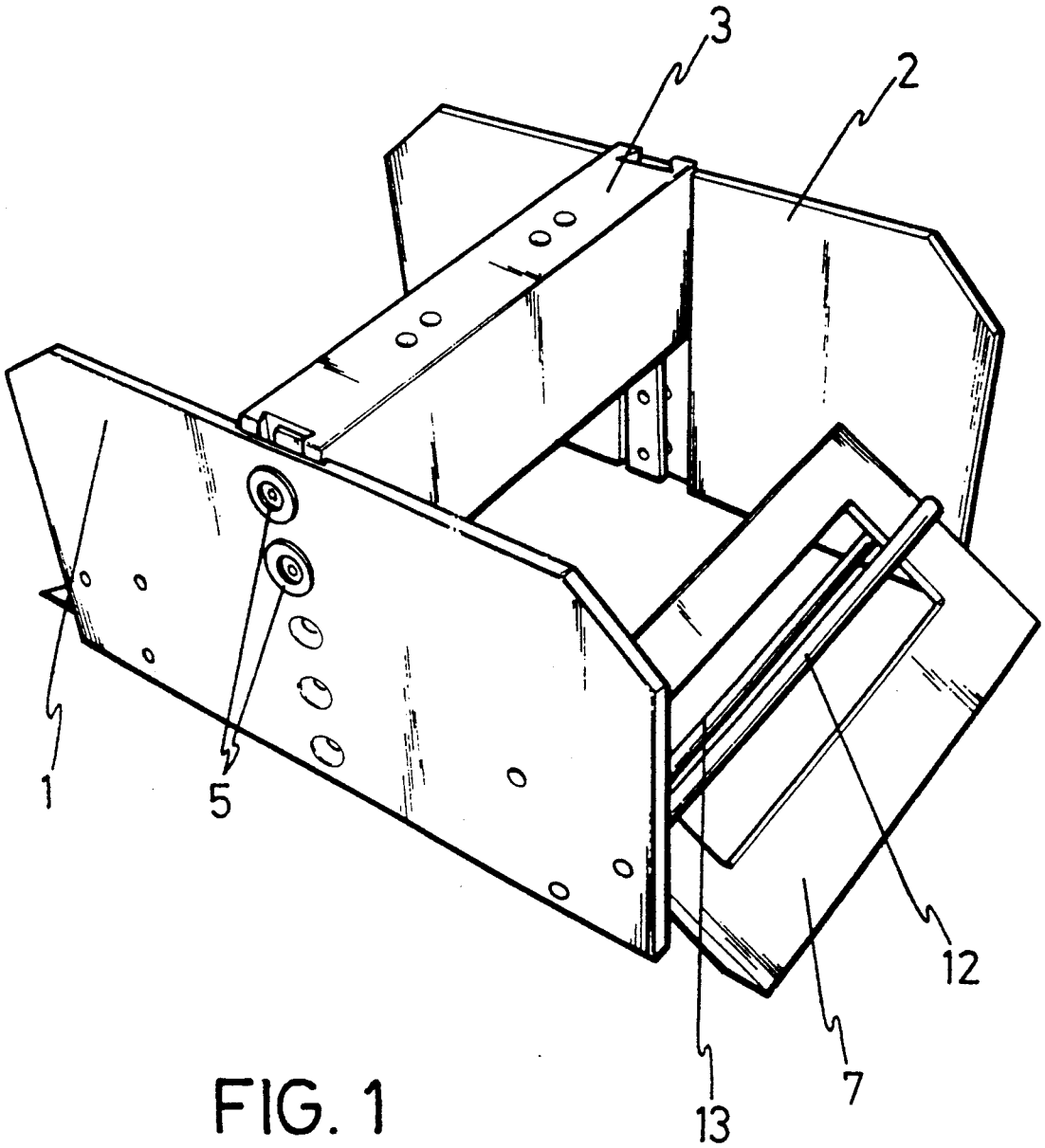
FIG. 1.-It shows a perspective view of the extensible former element, object of the improvements introduced in this type of machine, object of the invention.
Figure 2:
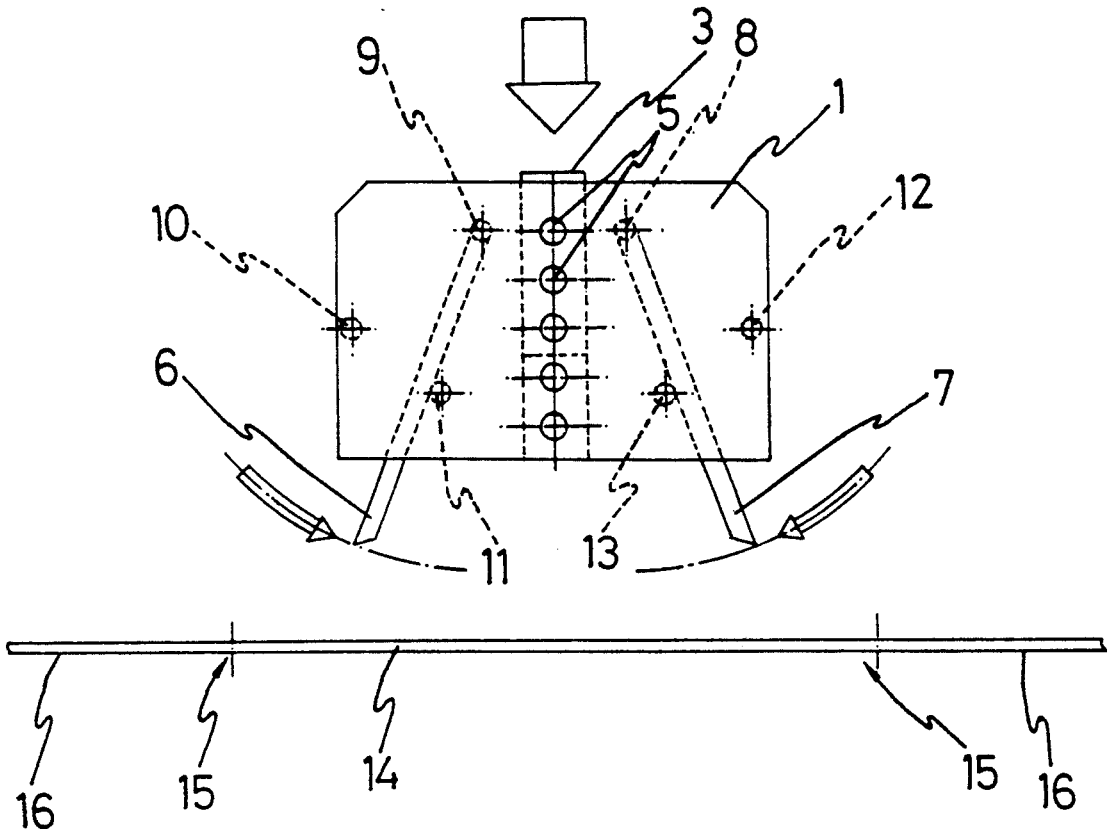
FIG. 2.-It shows a side view of the extensible former wherein the arrows indicate the pivoting of the wings.

Making reference to the numbering used in the figures, the improvements introduced in cardboard box forming machines, are mainly centered on the extensible former comprising two parallel opposite rectangular plates (1, 2), joined together by a bridge (3) or a fixed sheet (4) as an interior top surface.

The bridge (3) is formed by a rectangular prismatic body which fits in each end in some vertical guides made in the inner wall of each plate (1, 2.) This bridge (3) has a variable height upon being able to slide vertically between the guides, assuring its position by means of bolts (5.) When the former has this bridge (3), it can be said that it has a variable height since the vertical displacement of the same regarding the machine support can be varied upon varying the height of the bridge (3) in terms of the plates (1, 2.)

In the event that the plates (1, 2) are joined at the top by a sheet (4) as an interior top surface, the former is stationary, given that the above cited height cannot be varied.

Figure 6:
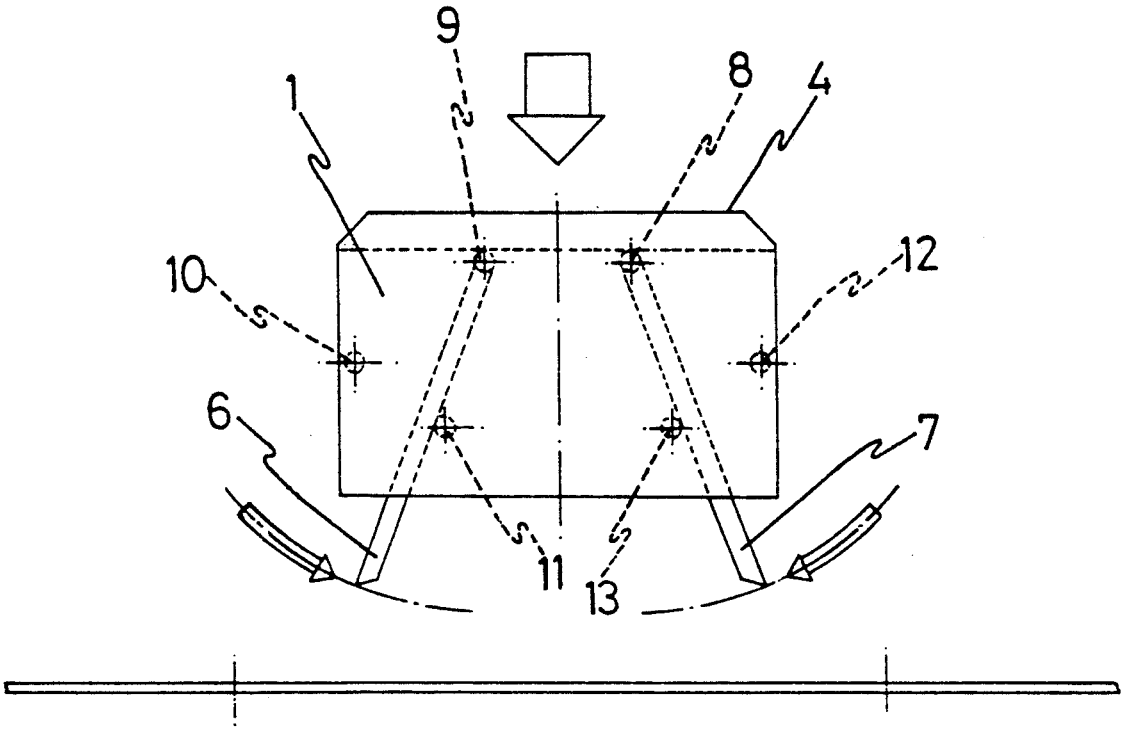
FIG. 6.-It shows a side view of the fixed former.

In both cases, between the plates (1, 2) there are two wings (6, 7) consisting of a flat surface that can have a rectangular plan shape with a large inner opening like the one shown in FIG. 1, or a "U" shape like the one shown in FIG. 6. In both cases, the bottom edge is bevelled, and the rectangular or "U" shape is justified to reduce weight.

These wings (6, 7) pivot from the ends of their top edges in terms of a horizontal rotation axis (8, 9) between the plates (1, 2) at a certain height. The wings (6, 7) have their pivoting delimited by some round profiles located between the same and at different heights. Each wing (6, 7) has its own profiles (10, 11, 12 and 13 respectively), of the limiting of the pivoting thereof.

With this arrangement of the former, it can be said that it is extensible, given that upon descending joined to the machine support, the wings (6, 7) will slide over the bottom (14) of the cardboard plate opening up until their movement is prevented by some round profiles (10, 12), respectively, determining the bevelled edge of each wing (6, 7) at this moment, the folded edge (15) of the walls (16) of the box located underneath.

This folding can be done thanks to the pressure exerted on the former, by the support, since it is transmitted to the box.

The folding will, likewise, be done upon the other walls of the box, until they come up against the plates (1, 2.)

Figure 3:
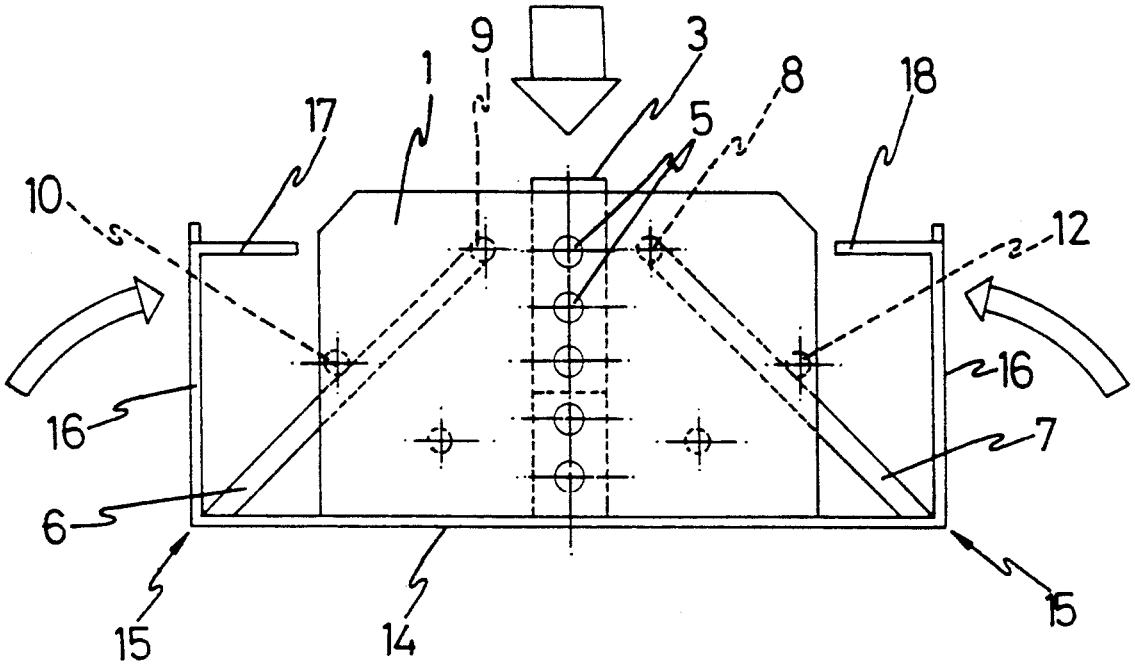
FIG. 3.-It shows a schematic view of how the cardboard box is formed upon the extensible former being situated with the wings extended.
Figure 4:
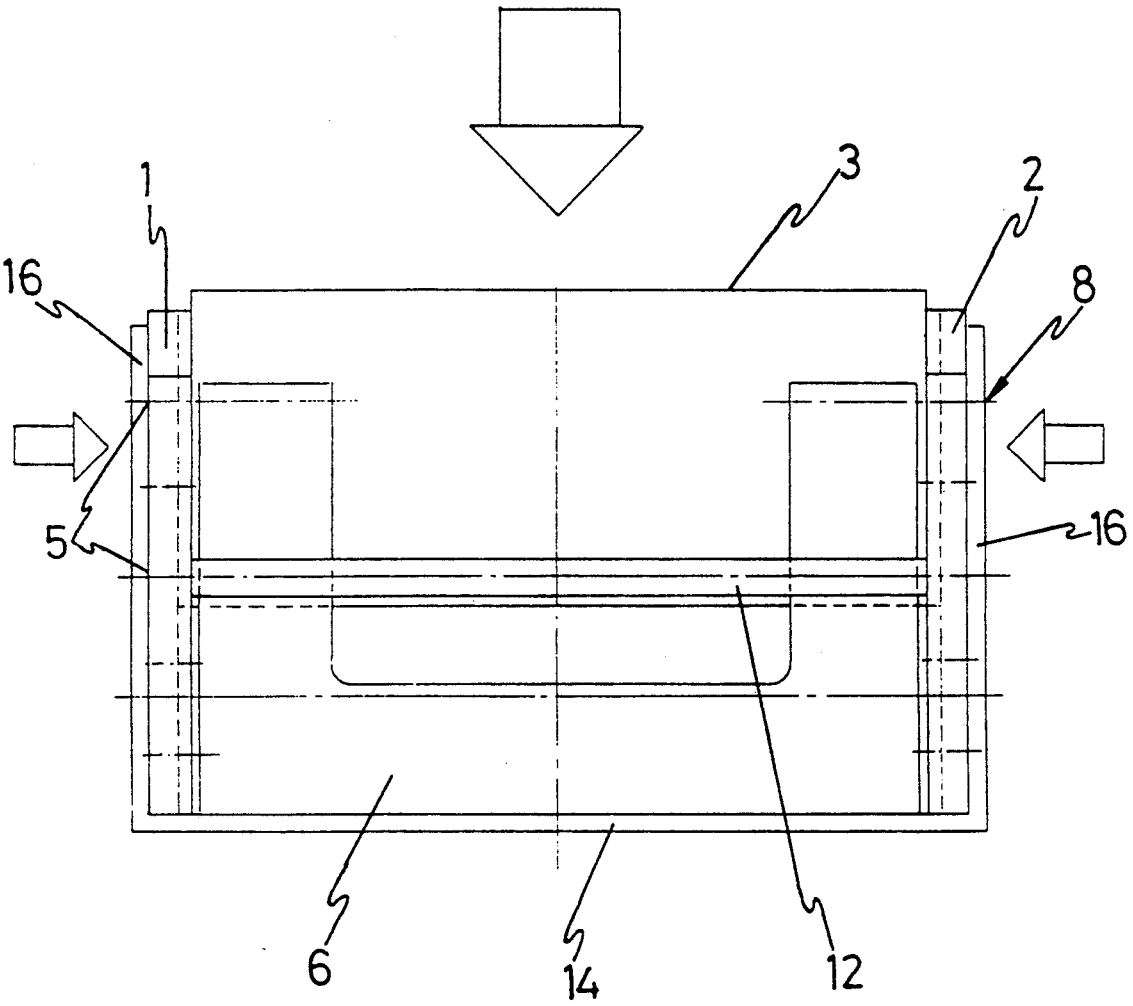
FIG. 4.-It shows a front view of the variable former element wherein the arrows indicate the pressure exerted on the sides of the box in order to fold them as well as on the top area of the former on the bottom of the same.
Figure 5:
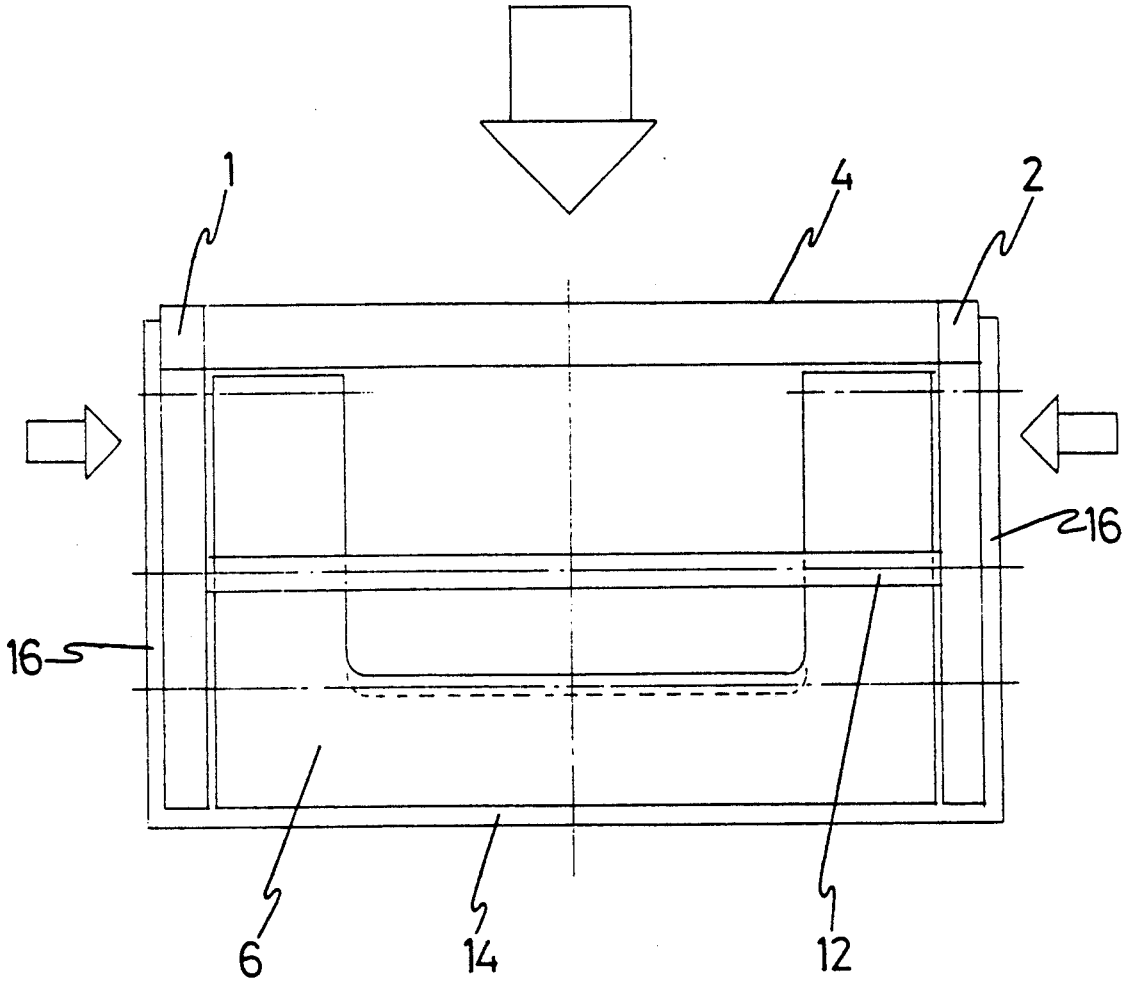
FIG. 5.-It shows a front view of a fixed former element, without a bridge, wherein the arrows indicate the pressures exerted as in FIG. 4.

Once the side walls (16) of the entire box are formed as shown in FIGS. 3 and 4, the former rises and the wings (6, 7) pivot by gravity until they touch the rounded profiles (11, 13). respectively, located underneath, with the advantage that if the box has horizontal bridges (17, 18), the former will be able to come out since the wings (6, 7) have withdrawn and they will not touch the wings.

Whether the wings (6 7) are rectangular or "U"-shaped they act in the same manner; and if the former has a bridge (3) or a sheet (4) like an interior top surface, between the plates (1, 2) it is due to the diversity of shapes that these wings or plates can have in order to adapt to the different types of boxes to be folded.

Likewise, the wings as well as the plates can be interchangeable, whereby a large number of types of boxes can be covered with a small number of wings and plates.

I claim:

1. A box forming apparatus for forming a box from a cardboard blank, said apparatus comprising:

two substantially rectangular end plates, said end plates lying in parallel planes;

a bridge element connecting said two end plates;

a first and second substantially rectangular wing plates, said wing plates pivotally attached to said end plates, said wing plates lying in planes orthogonal to said end plate planes;

a first pair of stops on said end plates, said first stops preventing rotation of said wing plates past a first predetermined angle with respect to a center line of said end plates; and a second pair of stops on said end plates, said second stops preventing rotation of said wing plates past a second predetermined angle with respect to said center line of said end plates.

2. An apparatus according to claim 1 wherein said bridge element is adjustably connected to said end plates.

3. An apparatus according to claim 2 wherein said adjustable connection is achieved by a guide on interior walls of said end plates and bolts extending through said end plates into said bridge element.

4. An apparatus according to claim 1 wherein bottom edges of said wing plates are beveled.

5. An apparatus according to claim 1 wherein said first and second stops are bars extending between said end plates.

* * * * *